US010835933B2

(12) United States Patent
Luby et al.

(10) Patent No.: US 10,835,933 B2
(45) Date of Patent: Nov. 17, 2020

(54) PRESSURE WASHER HAVING A TUBULAR FRAME MEMBER

(71) Applicant: KARCHER NORTH AMERICA, INC., Denver, CO (US)

(72) Inventors: Charles J. Luby, Bailey, CO (US); Michael Meyer, Schwaikheim (DE); Marcos Moreno Pastor, San Nicolas de los Garza (MX)

(73) Assignee: KARCHER NORTH AMERICA, INC., Denver, CO (US)

( * ) Notice: Subject to any disclaimer, the term of this patent is extended or adjusted under 35 U.S.C. 154(b) by 152 days.

(21) Appl. No.: 15/945,977

(22) Filed: Apr. 5, 2018

(65) Prior Publication Data

US 2018/0290180 A1 Oct. 11, 2018

Related U.S. Application Data

(60) Provisional application No. 62/482,098, filed on Apr. 5, 2017.

(51) Int. Cl.

| | |
|---|---|
| ***B08B 3/02*** | (2006.01) |
| ***F02B 63/06*** | (2006.01) |
| ***F04B 17/06*** | (2006.01) |
| ***F04B 17/05*** | (2006.01) |

(52) U.S. Cl.

CPC ..... *B08B 3/026* (2013.01); *B08B 2203/027* (2013.01); *B08B 2203/0223* (2013.01); *B08B 2203/0241* (2013.01); *F02B 63/06* (2013.01); *F04B 17/05* (2013.01); *F04B 17/06* (2013.01)

(58) Field of Classification Search

CPC ..... B08B 3/026; B08B 2203/0211; B08B 2203/027; B08B 2203/0241; B08B 2203/0223; F02B 63/04; F02B 63/047; F02B 63/048; F02B 63/06; F02B 2063/045; F02B 2063/046; F04B 17/06; F04B 17/05; F04B 35/002; F04B 35/06

See application file for complete search history.

(56) References Cited

U.S. PATENT DOCUMENTS

| | | | |
|---|---|---|---|
| 3,940,065 | A | 2/1976 | Ware et al. |
| 5,299,767 | A | 4/1994 | Simpson |
| D375,590 | S | 11/1996 | Steinhart et al. |
| D378,037 | S | 2/1997 | Dunlap |
| D414,968 | S | 10/1999 | Thurston-Chartraw |

(Continued)

FOREIGN PATENT DOCUMENTS

| | | |
|---|---|---|
| CA | 2352902 | 1/2002 |
| CN | 2880608 | 3/2007 |

(Continued)

OTHER PUBLICATIONS

U.S. Appl. No. 29/681,236, filed Feb. 22, 2019, O'Kane et al.

(Continued)

*Primary Examiner* — Nathan C Zollinger
(74) *Attorney, Agent, or Firm* — Sheridan Ross P.C.

(57) ABSTRACT

A frame for a pressure washing device is provided. The frame comprises at least one tubular member and a plurality of bends are provided in the tubular member. The frame is preferably devoid of a support plate and is adapted to receive at least one of a power source and a pump that is directly mounted to the frame.

6 Claims, 14 Drawing Sheets

(56) References Cited

U.S. PATENT DOCUMENTS

| | | | | |
|---|---|---|---|---|
| D463,888 | S | 10/2002 | Rehkugler et al. | |
| D465,624 | S | 11/2002 | Kolicheski et al. | |
| D467,692 | S | 12/2002 | Morgan et al. | |
| 6,935,642 | B1 * | 8/2005 | Craig | B08B 3/026 280/47.24 |
| D542,065 | S | 5/2007 | Snell | |
| D547,021 | S | 7/2007 | Stein | |
| D579,612 | S | 10/2008 | Rutkowski et al. | |
| D580,610 | S | 11/2008 | Hawkins | |
| 7,475,888 | B2 * | 1/2009 | Craig | F02B 63/04 280/47.18 |
| 1,359,011 | A1 | 4/2009 | Hawkins | |
| D596,817 | S | 7/2009 | Glass et al. | |
| D622,471 | S | 8/2010 | Hernandez | |
| D634,083 | S | 3/2011 | Fay | |
| D639,001 | S | 5/2011 | Alexander et al. | |
| D648,082 | S | 11/2011 | Alexander et al. | |
| 8,083,497 | B2 * | 12/2011 | Gilpatrick | F04B 17/06 248/163.1 |
| D655,467 | S | 3/2012 | Hawkins | |
| D665,545 | S | 8/2012 | Alexander et al. | |
| 8,337,172 | B2 | 12/2012 | Klika et al. | |
| 8,408,882 | B2 | 4/2013 | Klika et al. | |
| D688,841 | S | 8/2013 | Van Deursen | |
| D703,888 | S | 4/2014 | Kahan et al. | |
| 8,783,587 | B2 | 7/2014 | Bearup et al. | |
| 8,794,209 | B2 * | 8/2014 | Klika | A01D 42/00 123/195 R |
| D779,746 | S | 2/2017 | Weinberg et al. | |
| D824,612 | S | 7/2018 | Alexander | |
| D824,613 | S | 7/2018 | Alexander | |
| D834,269 | S | 11/2018 | Masters | |
| D842,012 | S | 3/2019 | Yang | |
| D854,763 | S | 7/2019 | Alexander | |
| 2002/0122730 | A1 * | 9/2002 | Dexter | B08B 3/026 417/299 |
| 2006/0076779 | A1 | 4/2006 | Craig et al. | |
| 2006/0102212 | A1 | 5/2006 | Leasure et al. | |
| 2007/0169796 | A1 | 7/2007 | Johnson et al. | |
| 2011/0315176 | A1 * | 12/2011 | Gilpatrick | B08B 3/026 134/57 R |
| 2012/0124955 | A1 * | 5/2012 | Klika | A01D 42/00 56/17.3 |
| 2018/0021819 | A1 * | 1/2018 | Schaller | B62B 3/04 134/184 |

FOREIGN PATENT DOCUMENTS

| | | |
|---|---|---|
| CN | 304794963 | 8/2018 |
| EM | 003255488-0002 | 7/2016 |
| KR | 30-0694718 | 5/2013 |

OTHER PUBLICATIONS

International Search Report and Written Opinion for International (PCT) Patent Application No. PCT/US2018/26162, dated Jun. 29, 2018, 10 pages.

U.S. Appl. No. 29/707,230, filed Sep. 26, 2019, Pastor et al.

International Preiiminary Report on Patentability for International (PCT) Application No. PCT/US2018/26162, dated Oct. 17, 2019, 9 pages.

"Karcher K 2400 HH (1.194-301.0) Pressure Washer Parts," eReplacementParts, 2019, retrieved from www.ereplacementparts.com/karcher-2400-11943010-pressure-washer-parts-c-33388_33389_33656.html, 17 pages.

Official Action for Australian Patent Application No. 202011257, dated Apr. 9, 2020, 3 pages.

Notice of Allowance for U.S. Appl. No. 15/945,977, dated Mar. 23, 2020, 7 pages.

* cited by examiner

PRESSURE WASHER HAVING A TUBULAR FRAME MEMBER

This application claims the benefit of priority from U.S. Provisional Patent Application Ser. No. 62/482,098, filed Apr. 5, 2017, the entire disclosure of which is hereby incorporated by reference.

FIELD

The present disclosure relates generally to low cost and high functionality frame members for various portable devices. More specifically, the present disclosure and various embodiments disclosed herein relate to frame members suitable for use with pressure washers and similar devices.

BACKGROUND

Commercial and residential pressure washing devices comprise various shapes and sizes. Some are truck or trailer-mounted devices, while others are smaller frame-mounted devices typically suitable for residential or personal uses.

The present disclosure is directed to the latter type of equipment, which currently suffers from various drawbacks. These devices typically comprise substantial frame members and mounting plates that increase the overall size and weight of the device. These increase production costs and occupy valuable space on shipping containers and store shelving. Such devices also take up valuable space in an end-user's household or garage and are generally difficult to store when not in use. These devices are also cumbersome and heavy for a user to transport and manipulate, even when the frame is provided with wheels for enhancing mobility. Some of these prior art devices are shown in U.S. Pat. No. 8,337,172 to Klika et al., and U.S. Pat. No. 8,783,587 to Bearup et al., which are incorporated herein in their entireties by this reference.

As will be seen, such devices include a plate that attaches to a frame and to which a power source and pump can be attached. That type of plate is shown as item 1016 in FIG. 14 of the Klika reference, for example, and is referred to herein as the "supplemental mounting plate."

SUMMARY

There has been a long-felt and unmet need to provide a portable pressure washing device comprising a power source, a pump, and a compact frame member. There is also a need to provide a compact frame member for a pressure washer and similar devices and wherein the frame member enables enhanced packing efficiency of the device in an assembled, partially assembled, or disassembled state, and wherein the frame member nevertheless provides sufficient structural stability to the device.

Embodiments of the present disclosure are directed to frame members for pressure washers and similar devices. Although various embodiments of the present disclosure contemplate pressure washing devices and features, frame members of the present disclosure are not limited to use with pressure washers. It is contemplated that frame members shown and described herein may be used with or equipped with a generator, an air compressor, a pump, a vacuum, an air mover, and similar equipment.

In various embodiments, a frame member for a pressure washing device of the present disclosure comprises a tubular frame member that is operable to receive and securely mount at least one of and perhaps several of an internal-combustion engine, an electric motor, and a pump. Tubular frame members of the present disclosure comprise at least one tubular member formed to a desired shape or shapes (i.e., round, oblong, square, rectangular, hexagonal, etc.) during initial fabrication. The tubular member is then fabricated into a frame by a plurality of bends, thereby eliminating or minimizing the need for welds and fasteners to join a plurality of tubes or sheet metal.

Frame members of the present disclosure are at least partially formed with the use of a tube bender. In some embodiments, bends are provided in a frame member. At least some of these bends are preferably provided with a minimum bending radius for the particular tube, while others will use a bend radius determined by components mounted to the frame member and/or other considerations. One of ordinary skill in the art will recognize that the minimum radius will vary based on the dimensions and geometry of a tube member, and crimping of the tube will result in damage to the tube member, thus rendering it unsuitable for use as a frame component. Accordingly, in preferred embodiments of the present disclosure, a method of forming a frame member is provided wherein the method comprises the steps of determining a minimum and/or structurally optimized bending radius for at least one tube member and forming said tube member to the selected radius using a tube bender.

In preferred embodiments, frame members of the present disclosure are void of a supplemental mounting plate and at least one of an engine, a motor, and a pump is secured directly to the tubular frame member. The absence of a supplemental mounting plate, as is typically provided with existing devices, reduces the overall size and weight of the device, the production cost of the device and the space in which the device can be packaged or stored. Surprisingly, the elimination of the base plate has not resulted in any negative functional parameters of the devices tested. In some embodiments, it has been found that lack of a mounting plate reduces the operation noise produced by the device due to the elimination of a steel plate that can act as a drum head and amplify vibration noise produced by working components, such as the engine or the pump.

In some embodiments, an upper frame member and a lower frame member are provided. The upper frame member comprises a tubular member having a first bend and a second bend. A handle or user-interface portion is provided between the first bend and the second bend. The first bend and the second bend each comprise transitions between the handle member and elongate members that extend generally downwardly away from the handle member. The lower frame member comprises a tubular member having a first portion extending in a direction substantially parallel to the handle member of the upper frame member. The first portion is operable to be provided in proximity to or in contact with a ground surface for providing a support to the frame and associated components. The lower frame member further comprises first and second bends at opposing ends of the first portion. The first and second bends extend upwardly toward horizontal support members that extend approximately parallel to one another and provide at least one support surface for a primary power source and a pump.

In one embodiment, a portable pressure washer is provided. The pressure washer comprises a primary power source, a pump, and a frame that may be provided with at least one wheel. The frame comprises an upper portion and a lower portion, the upper portion comprises a tubular member bent to provide a handle portion and a pair of tubular members extending away from the handle portion. The lower portion comprises a tubular member having a plurality of bends and wherein the lower portion is formed into an arcuate shape. An axle member is provided that comprises a tubular member void of bends. The upper portion is welded to the lower portion, and the lower portion is welded to an axle member. In preferred embodiments, the device is void of a plate member and at least one of the primary power source and the pump, and in some embodiments both are mounted directly to the frame member.

In one embodiment, a portable frame member is provided. The portable frame member comprises a first tubular member formed into an arcuate shape and a second tubular member formed into an arcuate shape. A tubular axle member is provided that comprises an elongate member void of bends and can be comprised of a tube of any shape or multiple shapes. The first tubular member comprises a pair of bends defining a handle portion and two support members extending away from the handle portion. The second tubular member comprises a plurality of bends to provide an arcuate support member. The first tubular member is secured to the second tubular member, and the second tubular member is secured to the tubular axle member.

Although various embodiments of the present disclosure contemplate tubular frame members, the present disclosure and devices contemplated herein are not limited to tubular frame members. In some embodiments, at least a portion of a frame member is provided as a non-tubular member. Non-tubular members for use with embodiments of the present disclosure include, but are not limited to, rails, bars, I-beams, flanged beams, webbed beams, truss beams, cellular beams, etc.

The Summary of the Invention is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become more readily apparent from the Detailed Description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, explain some of the principles of the disclosure.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
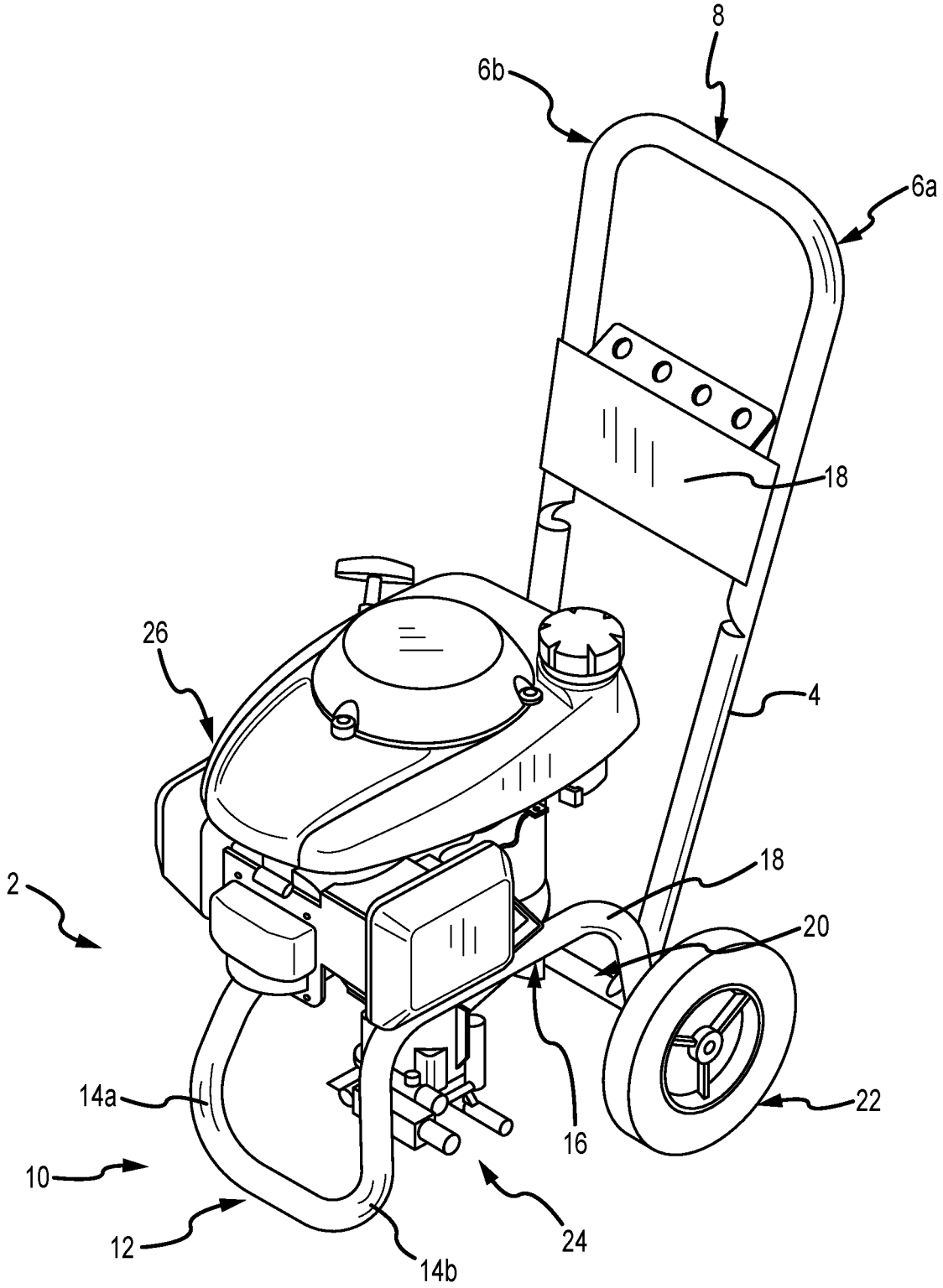

FIG. 1 is a front perspective view of a pressure washing device having an associated frame member according to one embodiment of the present disclosure.

Figure 2A:
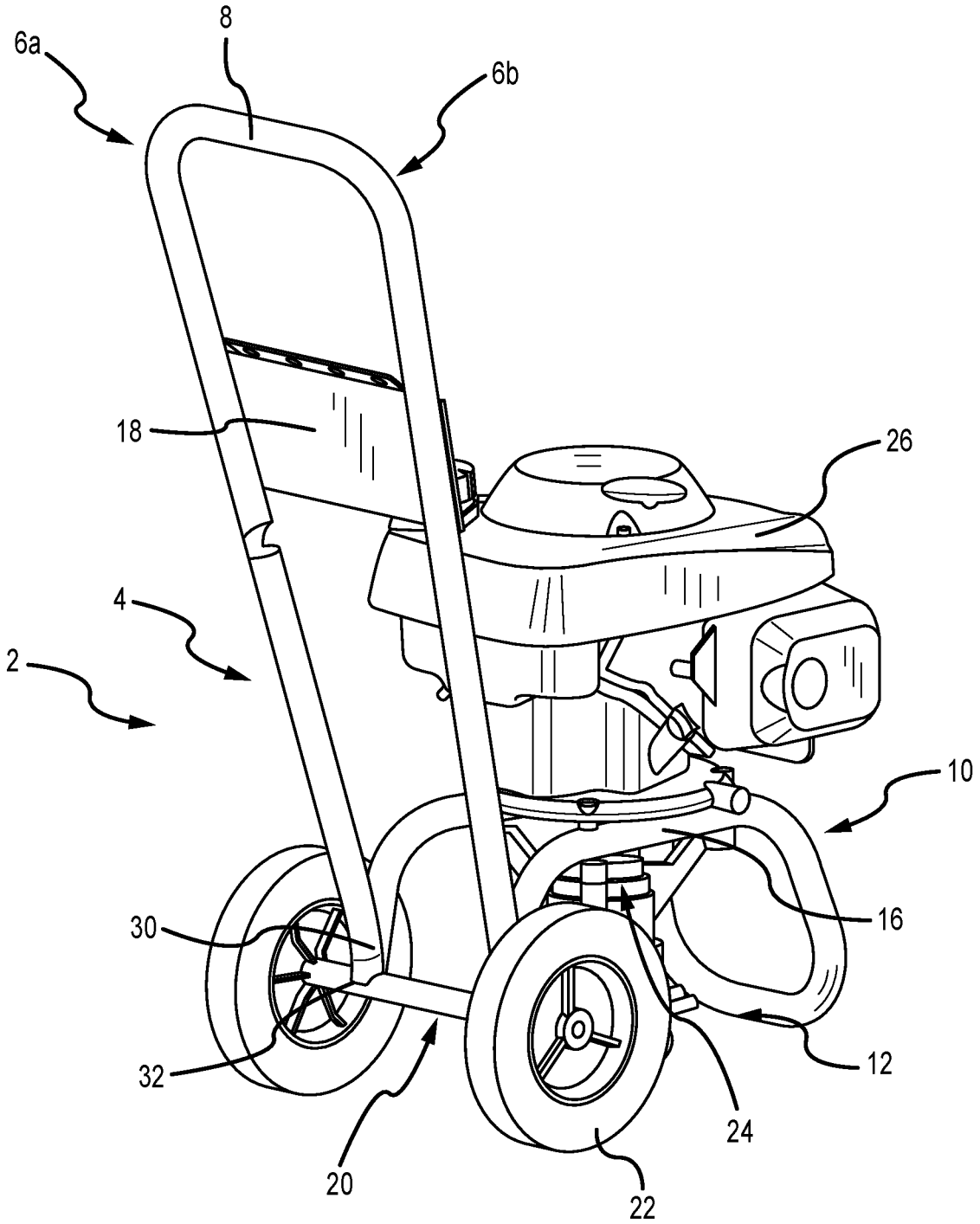

FIG. 2A is a rear perspective view of the pressure washing device having an associated frame member according to the embodiment of FIG. 1.

Figure 2C:
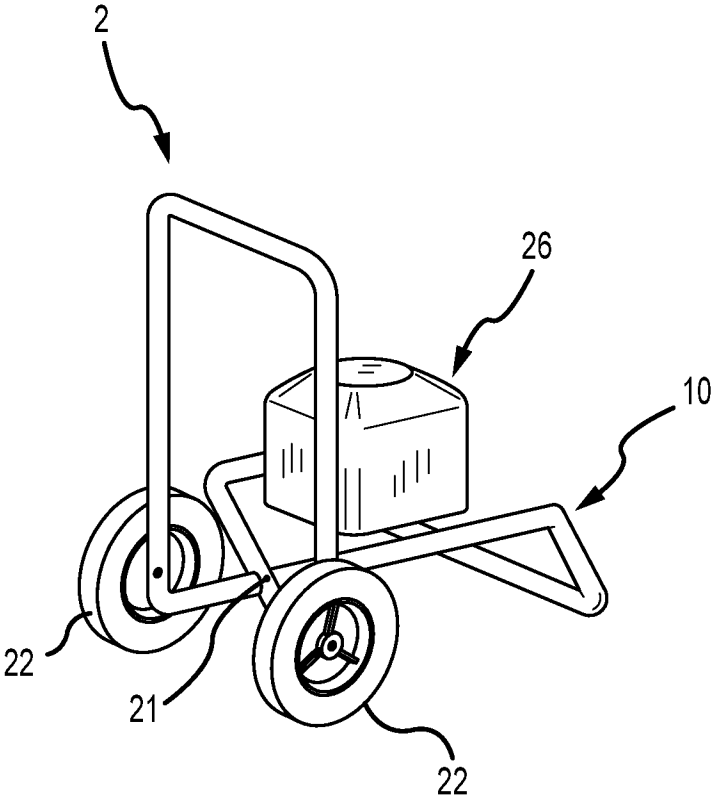
Figure 2B:
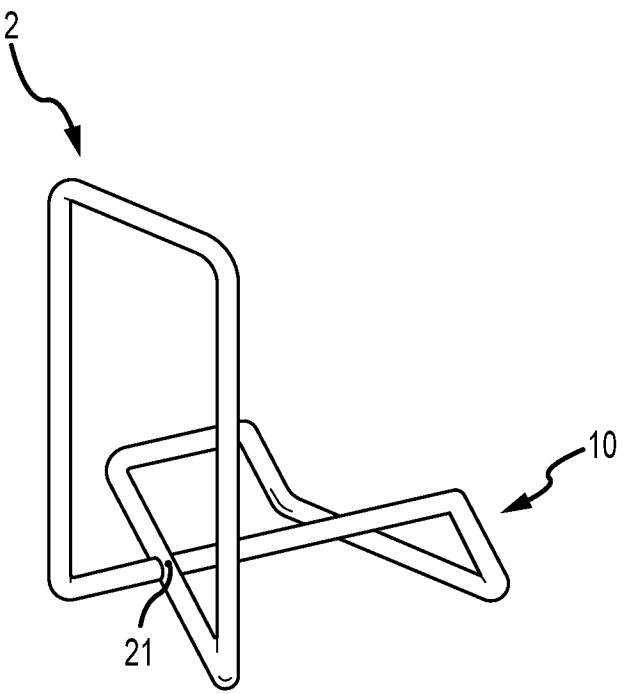

FIG. 2B is a rear perspective view of a frame member according to another embodiment of the present disclosure.

FIG. 2C is a rear perspective view of the frame member of FIG. 2B with a working component provided therein.

Figure 3:
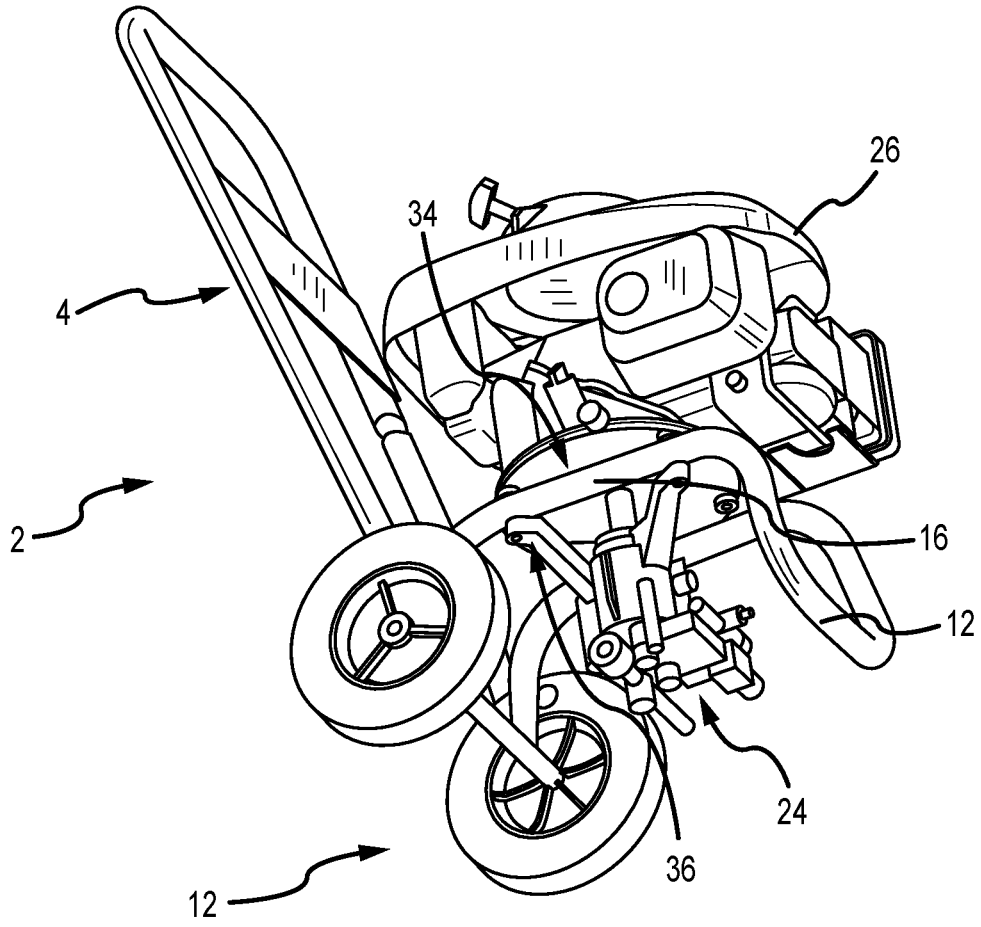

FIG. 3 is a bottom perspective view of the pressure washing device frame member according to the embodiment of FIG. 1.

Figure 4:
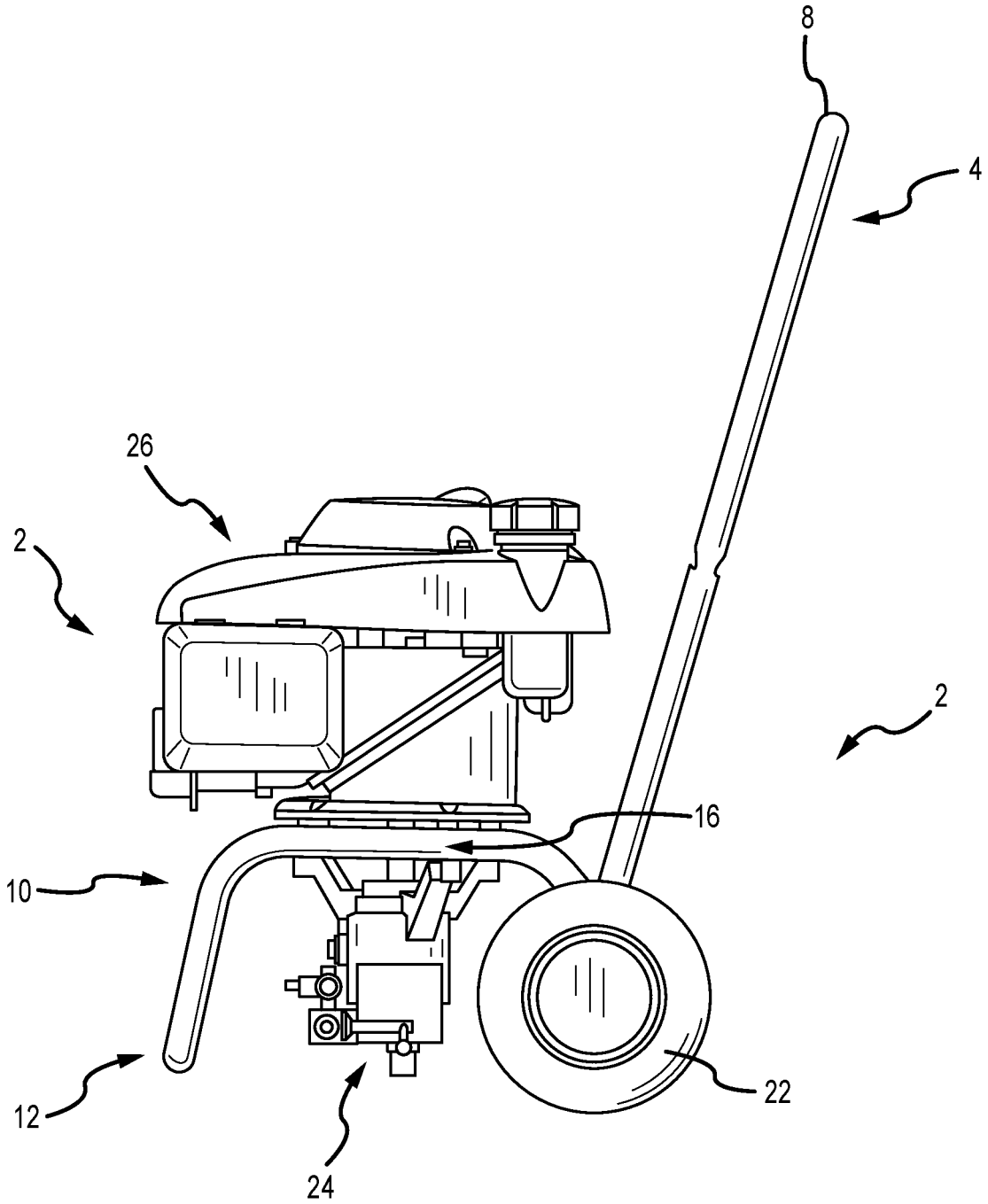

FIG. 4 is a right elevation view of the pressure washing device frame member according to the embodiment of FIG. 1.

Figure 5:
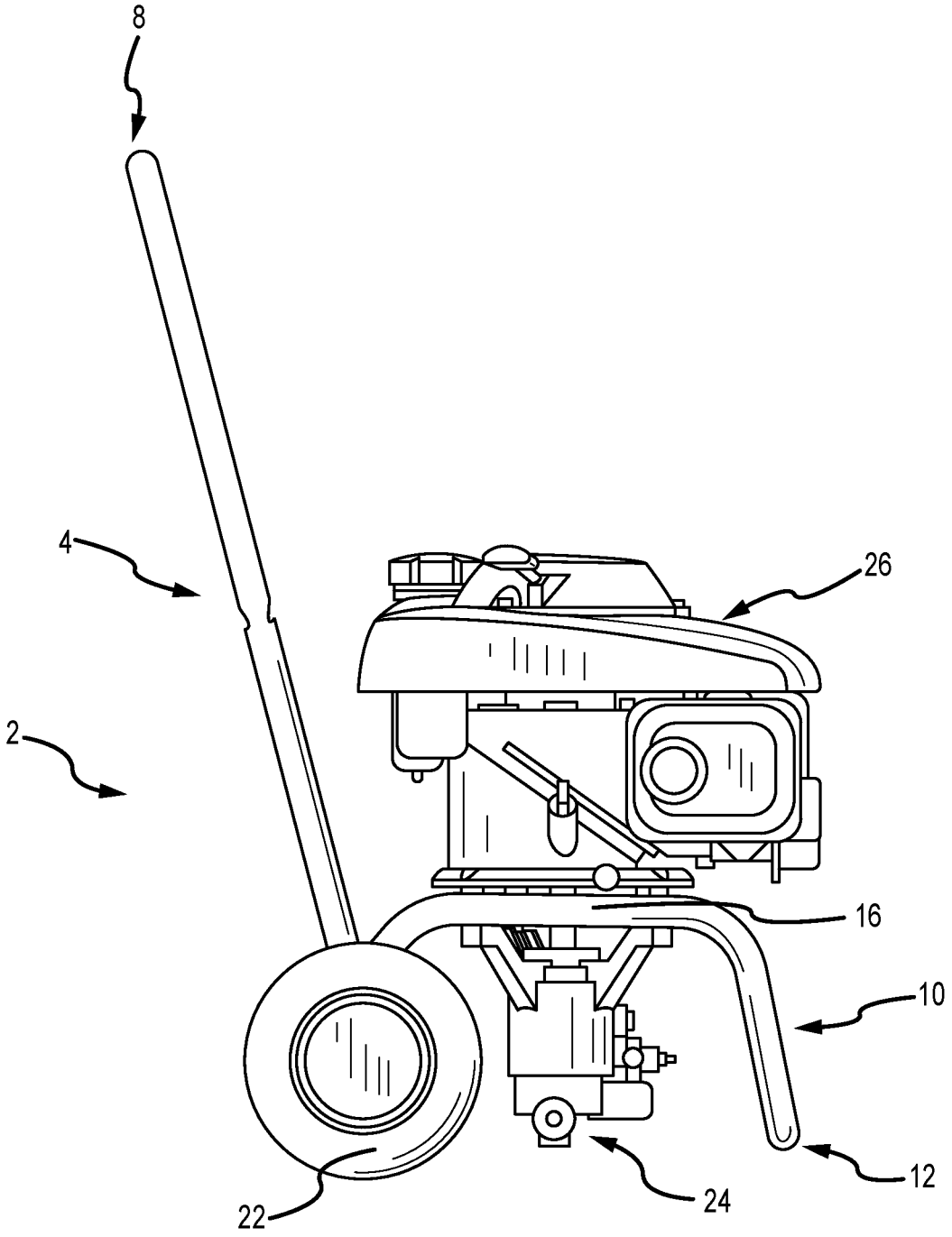

FIG. 5 is a left elevation view of the pressure washing device frame member according to the embodiment of FIG. 1.

Figure 6:
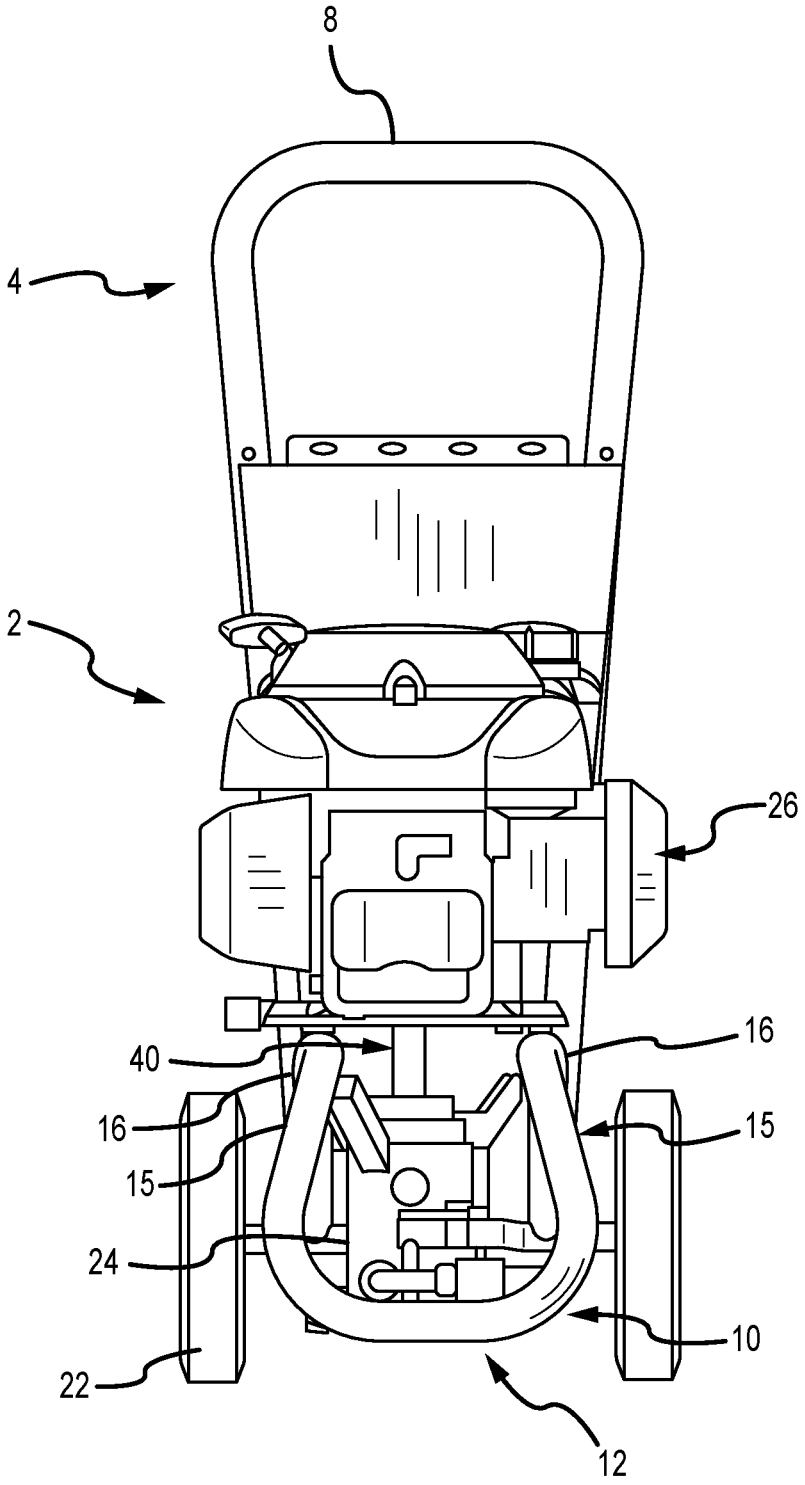

FIG. 6 is a front elevation view of the pressure washing device frame member according to the embodiment of FIG. 1.

Figure 7:
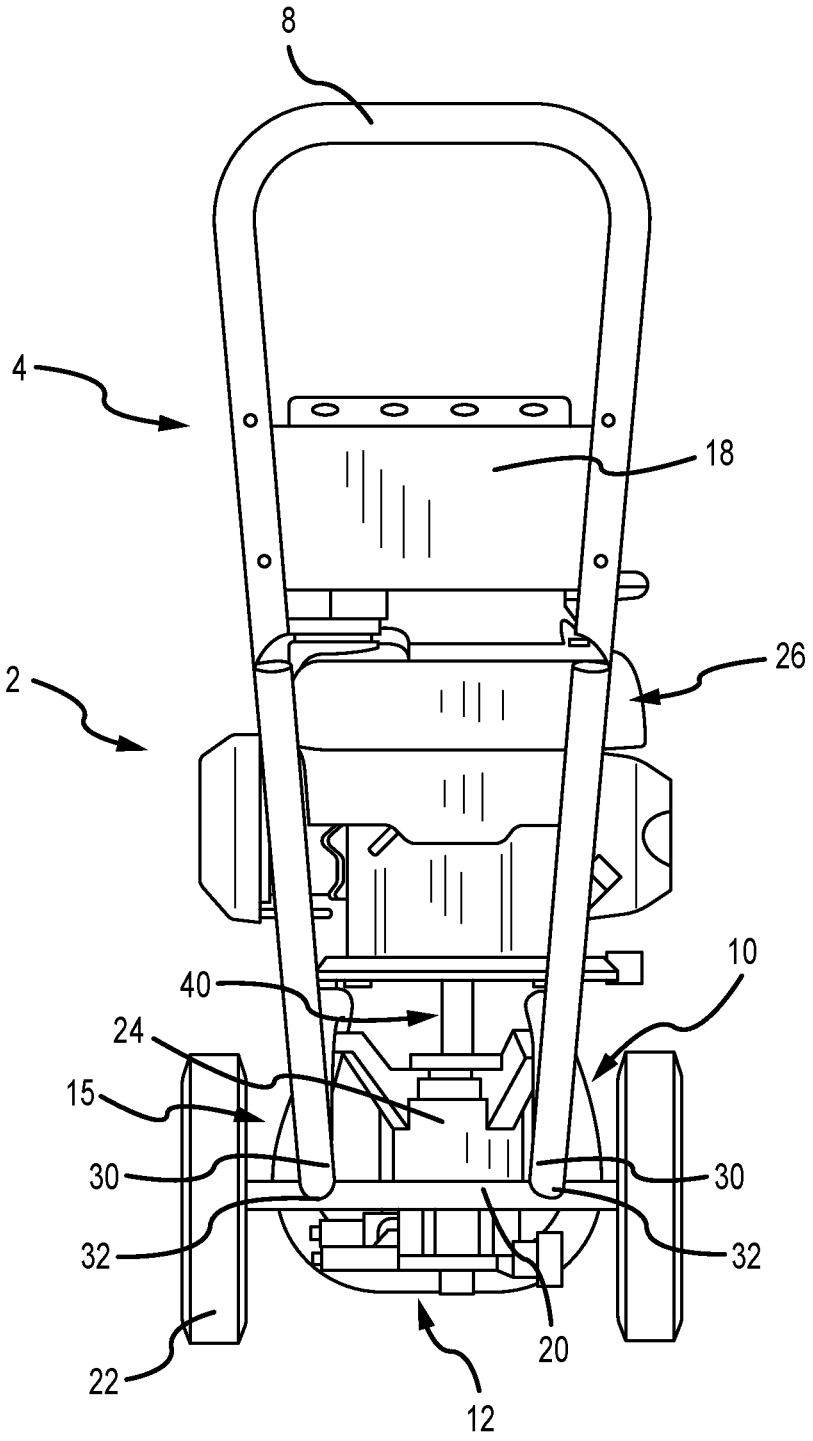

FIG. 7 is a rear elevation view of the pressure washing device frame member according to the embodiment of FIG. 1.

Figure 8:
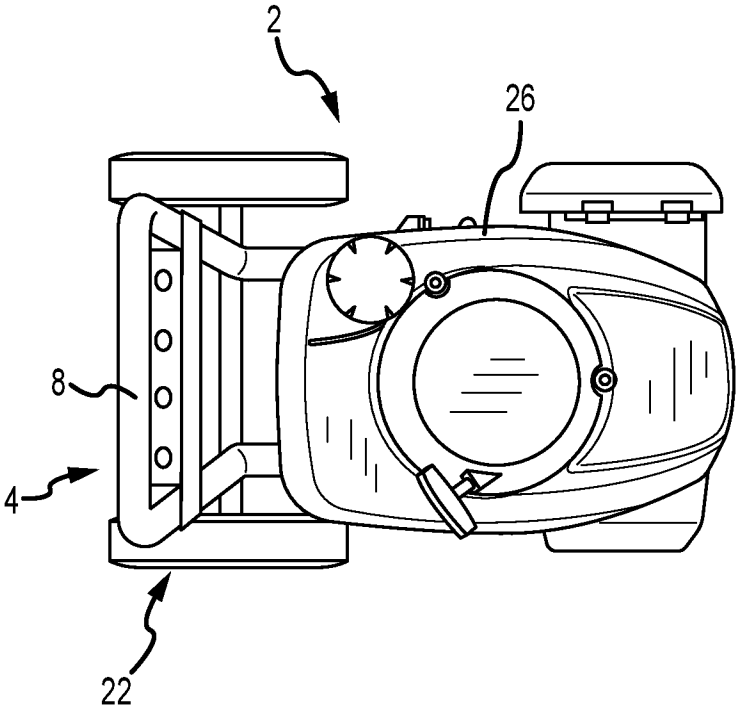

FIG. 8 is a top plan view of the pressure washing device frame member according to the embodiment of FIG. 1.

Figure 9:
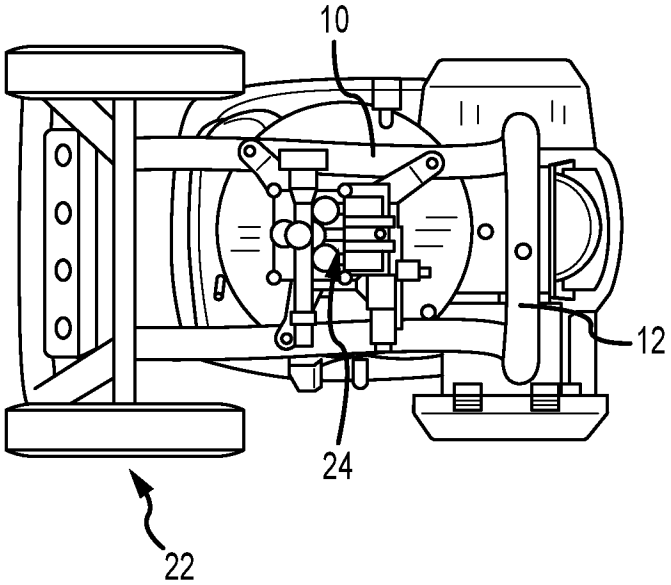

FIG. 9 is a bottom plan view of the pressure washing device frame member according to the embodiment of FIG. 1.

Figure 10A:
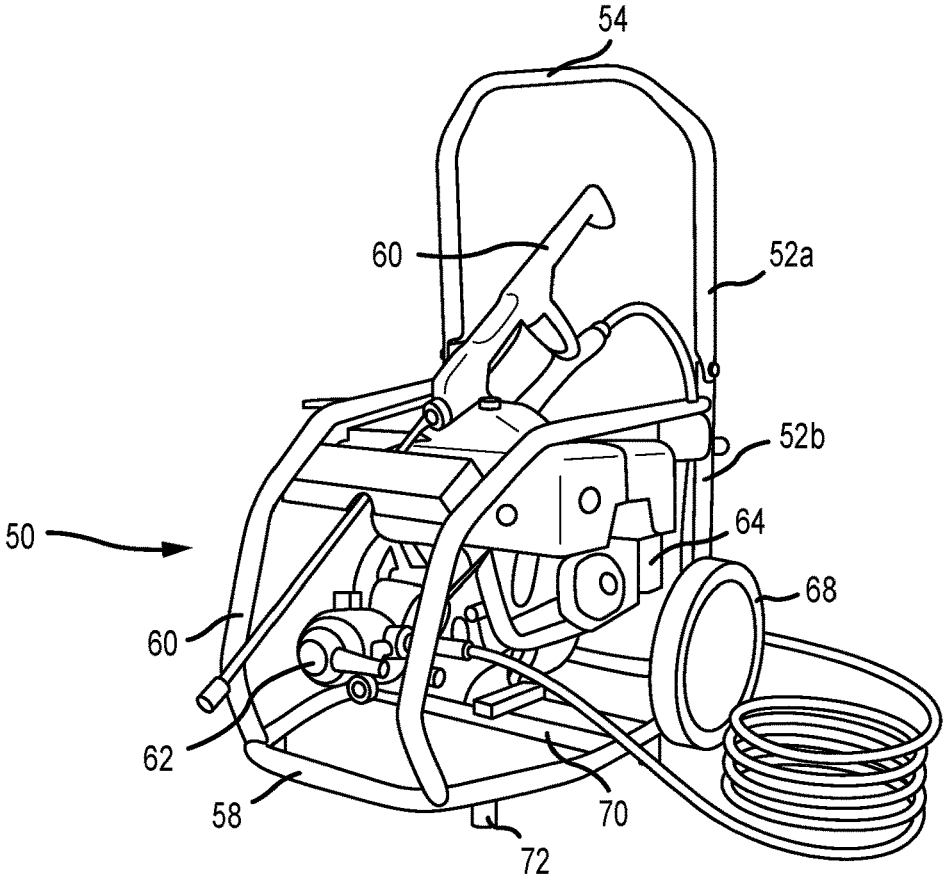

FIG. 10A is a perspective view of a pressuring washing device and frame member according to one embodiment of the present disclosure.

Figure 10B:
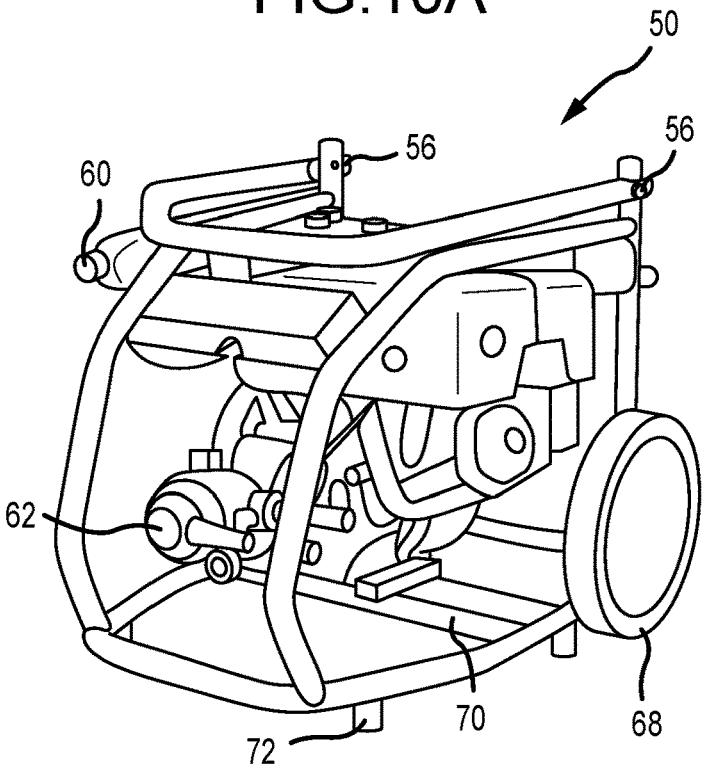

FIG. 10B is a perspective view of the pressure washing device and frame member of FIG. 10A.

Figure 10C:
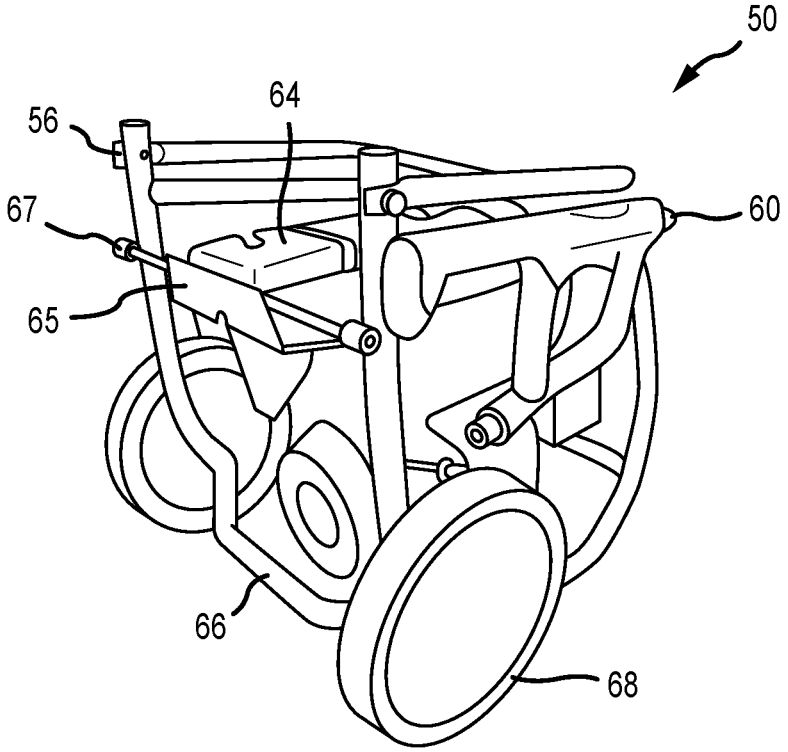

FIG. 10C is a rear perspective view of the pressure washing device and frame member of FIG. 10A.

Figure 10D:
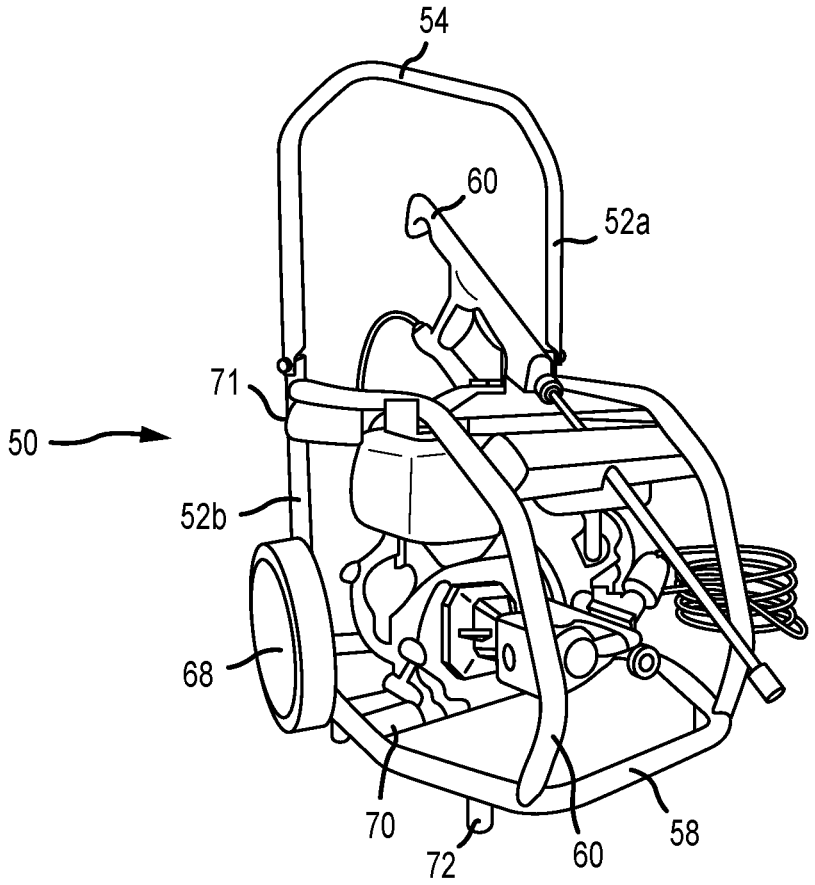

FIG. 10D is a perspective view of the pressure washing device and frame member of FIG. 10A.

Figure 10E:
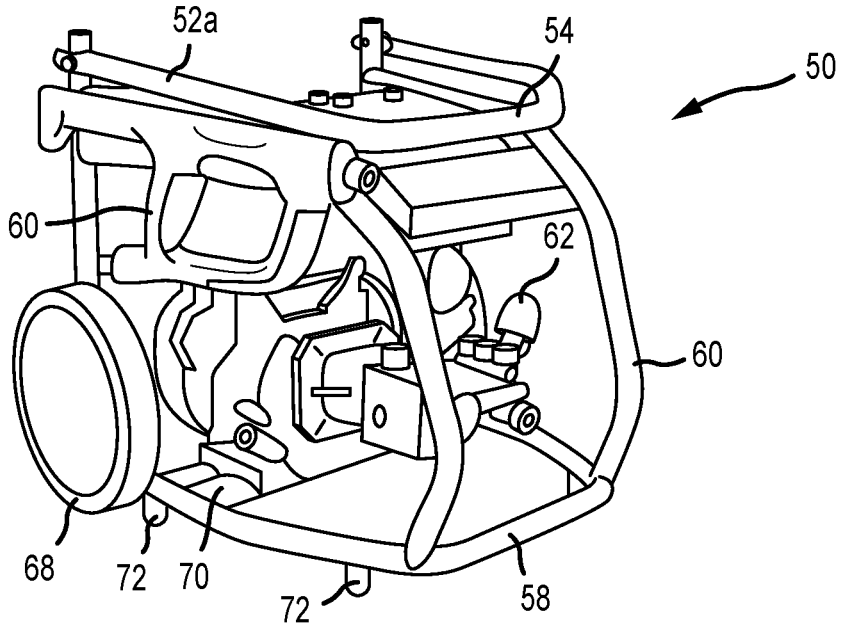

FIG. 10E is a perspective view of the pressure washing device and frame member of FIG. 10A.

Figure 11A:
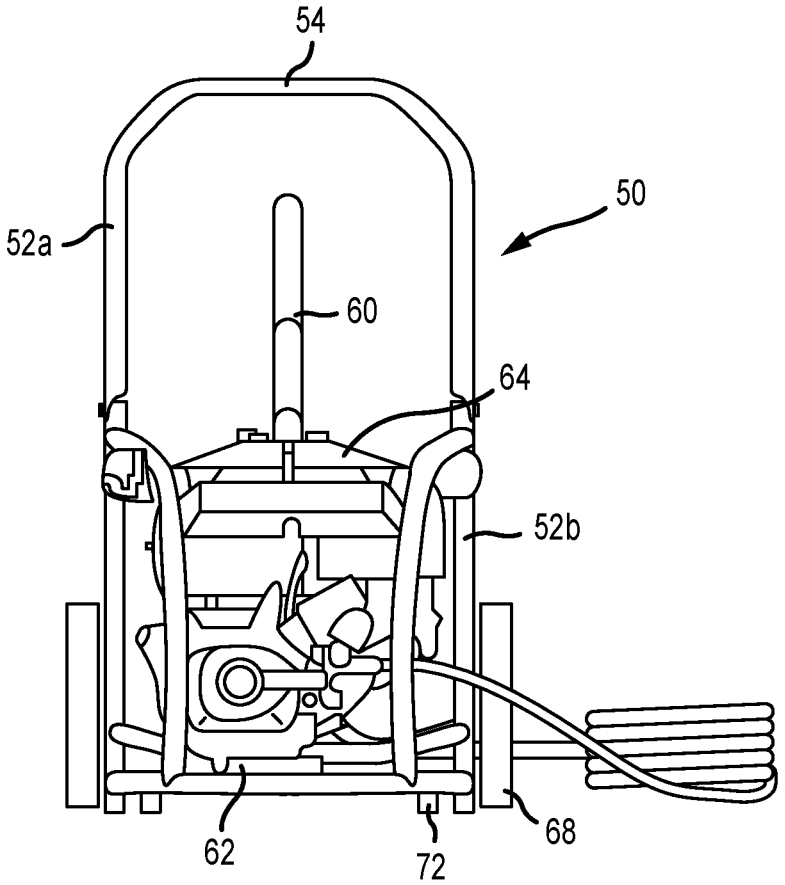

FIG. 11A is a front elevation view of a perspective view of the pressure washing device and frame member of FIG. 10A.

Figure 11B:
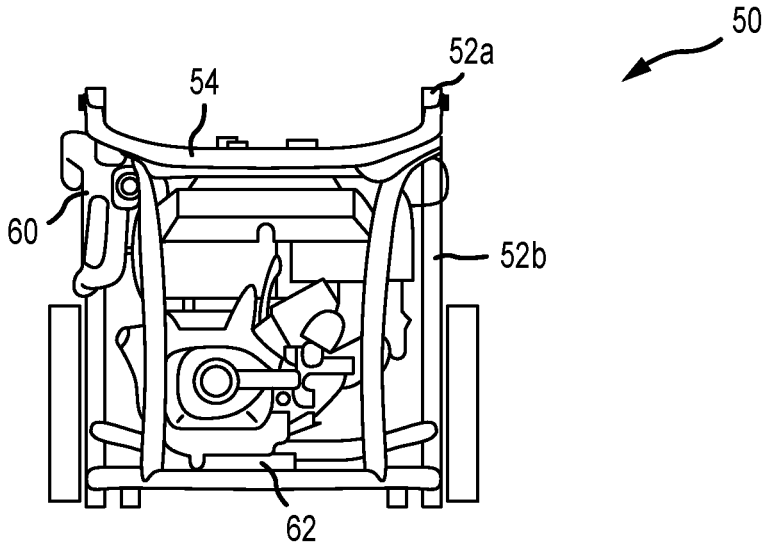

FIG. 11B is a front elevation view of a perspective view of the pressure washing device and frame member of FIG. 10A.

Figure 11C:
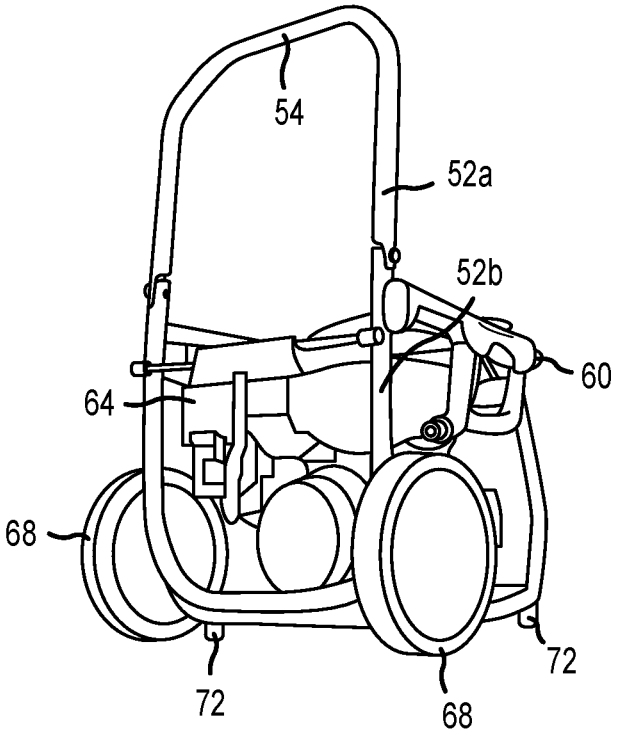

FIG. 11C is a rear perspective view of a perspective view of the pressure washing device and frame member of FIG. 10A.

Figure 11D:
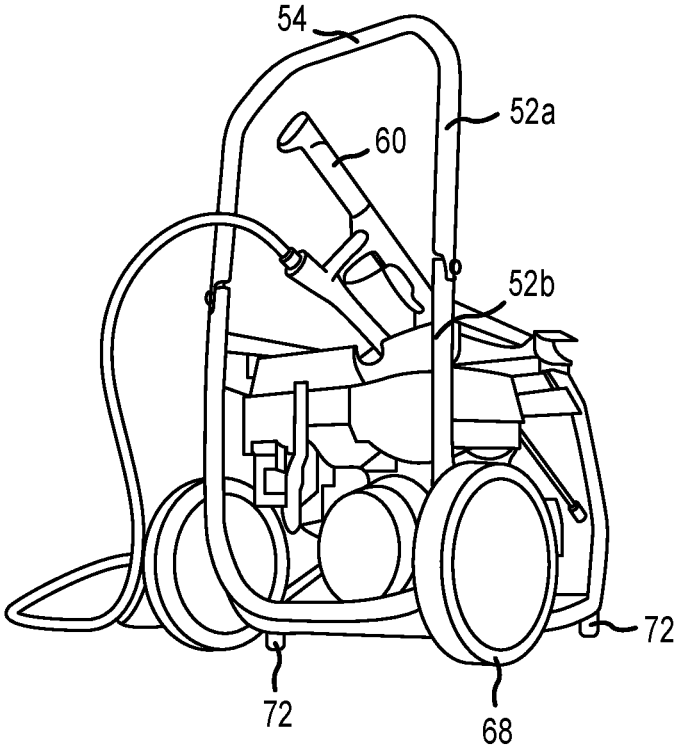

FIG. 11D is a rear perspective view of a perspective view of the pressure washing device and frame member of FIG. 10A.

DETAILED DESCRIPTION

FIG. 1 is a perspective view of a pressure washing device having a frame according to one embodiment of the present disclosure. As shown, the device 2 comprises a frame having a first frame member 4. The first frame member 4 comprises two upwardly extending members and a substantially horizontal handle member 8. The first frame member 4 and handle member 8 are preferably formed from a single piece of material, such as a tubular element that is provided with first 6*a* and second 6*b* bends to form the generally U-shaped feature shown in FIG. 1.

The frame further comprises a second frame member 10. The second frame member 10 comprises a lower portion of the frame that is operable to support pressure washing components including, for example, a pump 24 and a power source 26. The second frame member 10 comprises a lower support member 12, which extends to horizontal support members 16 by way of first and second bends 14*a*, 14*b* provided in the second frame member 10. Additional bends 18 are provided in the second frame member 10 to connect the second frame member 10 to at least one of the first frame member 4 and an axle member 20. The axle member 20, which may be a wholly or partially hollow or solid material, and it may but need not extend between wheels 22 of the device 2. The device of FIG. 1 thus comprises a frame member formed from not more than three members, and wherein each member can be bent or formed to a desired shape. In certain embodiments, a pump 24 is provided with a crank shaft or similar input that is substantially coaxial with a drive shaft of a power source 26.

Specifically, the device of FIG. 1 comprises a first frame member 4, a second frame member 10, and an axle member 20. These three components are joined by at least one of welding and by providing fasteners. In some embodiments, the first frame member 4, a second frame member 10, and the axle member 20 are welded together to form the frame arrangement shown in FIG. 1. Alternatively, at least one of the members is secured to at least one additional member by one or more fasteners.

FIG. 2A is a rear perspective view of the pressure washing device 2 and frame member according to the embodiment of FIG. 1. FIG. 2A shows a connection between the first frame member 4, the second frame member 10 and the axle member 20. Specifically, and as shown in FIG. 2A, the first frame member 4 is secured to the second frame member 10 by a first weld 30. The second frame member 10 is secured to the axle 20 by a second weld 32. First 30 and second welds 32 are provided on both sides of the frame, proximal to each of the wheels 22.

Alternatively, an axle member 20 can be eliminated as shown in FIGS. 2B-2C and the lower frame member 10 bent in such a way that wheel members 22 can be directly attached to the lower frame member 10. For enhanced structural integrity, a fastening member 21 can join two tubular sections where the two sections cross. The embodiments of FIGS. 2B-2C comprise the further advantage that the entire upper and lower portions of the frame can be made from one length of tubing, reducing the number of required welds (e.g. from four to one or fewer). The union of two tubular sections proximal to the fastening member 21 may comprise various bends or crimps. For example, the tubular sections may each be deformed such that they receive each other and allow the tubular portions to extend in a substantially co-planar manner at a distance away from the intersection. The bending or crimping of the tubular members may further help secure portions of the frame together and/or reduce vibration.

FIG. 3 is a bottom perspective view of the pressure washer 2 according to the embodiment of FIG. 1. FIG. 3 illustrates, for example, a connection between the pump 24, the power source 26 and the frame. As shown, the pump 24 and the power source 26 are directly mounted together through the frame. The power source 26, which may comprise a gas or diesel-powered engine, an electric motor, or any other similar device, is typically supplied with a base or mounting member 34. The horizontal support members 16 of the second frame member 10 comprise apertures or through holes. The pump 24 comprises feet 36, also having apertures. One or more fasteners are provided to extend through the feet 36 of the pump 24, the apertures of the horizontal support members 16 and secure to the base member 34 of the power source 26. The fasteners, which may comprise bolts or other suitable fasteners, provide a compression force to secure the pump 24 and the power source 26 to the second frame member 10. As shown, the pump 24 extends downwardly below the power source 26 and below at least a portion of the frame member. The power source 26 extends upwardly in an opposite direction. The geometry of the frame member and positioning of the working components of the pressure washer 2 provide for enhanced vibration damping and structural support, while reducing the overall weight and size of the device.

FIGS. 4-5 are right and left side elevation views of the pressure washing device 2 according to the embodiment of FIG. 1. As shown, the horizontal support members 16 of the second frame member 10 are provided at a height above a ground surface, such that there is adequate room for the pump 24 to extend downwardly therefrom. The lower support member 12 and the wheels 22 provide a stand-off height that provides space for the pump 24 to be provided in the position shown in FIGS. 4-5.

The position and the orientation of the pump 24, at least as shown in FIG. 5, provides for enhanced access to pump components including, for example, a high-pressure fluid outlet and a low-pressure fluid inlet. The orientation of the pump 24 and associated frame structure also reduces contact points and features on which hoses may get stuck or tangled, thereby providing an improved ergonomic experience for the user.

FIG. 6 is a front elevation view of the pressure washing device 2 according to the embodiment of FIG. 1. As shown in FIG. 6, a frame member comprises a first frame member 4 and a second frame member 10. The second frame member 10 comprises a lower support member 12 that provides a support or contact feature when the device 2 is not being transported (when transported, the device is tipped backward, lifting lower support member from the ground). The second frame member 10 further comprises horizontal support members 16. The lower support member 12 and the horizontal support members 16 are preferably formed from a single component. In some embodiments, the second frame member 10 comprises a single tubular element that is bent or otherwise shaped to the position and orientation shown in FIG. 6. The orientation provided in FIG. 6 comprises a pair of horizontal support members 16 that extend in a direction that is substantially perpendicular to a lower support member 12. The lower support member 12 extends in a width direction of the device, and the length of the lower support member 12 that extends in the width direction comprises a length that is greater that a spacing provided between the horizontal support members 16. The horizontal support members 16 comprise substantially parallel members with a gap or space between the members. The gap between the two horizontal support members 16 comprises a width that extends in the same direction as the length of the lower support member 12. The spacing between the two horizontal support members 16 comprises a reduced width relative to the widest portion of second frame member 10, wherein upwardly extending support members 15 of the second frame member 10 comprise an inwardly-extending angle or taper. The frame geometry shown in the embodiment of FIG. 6 provides enhanced structural stability and vibration damping, while reducing overall space needed to store the device, while still providing the appropriately-sized mounting surface for the power source 26 and/or the pump 24.

Additionally, and as shown in FIG. 6, the frame member is void of a supplemental mounting plate upon which the power source 26 and/or the pump 24 are to be mounted. Rather, the pump 24 and the power source 26 are directly mounted to the tubular frame, and a void space is provided between the pump 24, the power source 26 and the frame members 16. This void space allows for reduced weight and enables a drive shaft 40 to extend unimpeded from the power source 26 to the pump 24.

FIG. 7 is a rear elevation view of the pressure washing device 2 and associated frame member according to FIG. 1. FIG. 7 provides various features and components as shown and described with respect to FIGS. 1-6. FIG. 7 also illustrates a plurality of welds 30, 32 that are provided to join the first frame member 4, the second frame member 10, and the axle member 20 in accordance with at least one embodiment of the present disclosure. As shown, the first frame member 4 is joined to the second frame member 10 by a pair of first welds 30, and the second frame member 10 is jointed to the axle member 20 by a pair of second welds 32. Thus, in preferred embodiments of the present disclosure, a pressure washer frame can be constructed that includes only four total welds. Welding and assembly time is thereby reduced, and a simplified, structurally stable, lightweight device with increased packing and shipping efficiency is provided.

In alternative embodiments, it is contemplated that at least one of the frame member is not welded, but is selectively securable to additional members by fasteners. For example, in one embodiment, it is contemplated that the first frame member 4 is selectively securable to the second frame member 10 by one or more fasteners (e.g. nuts and bolts) to allow the first frame member 4 to be selectively detached for storage, shipment, etc. As skilled artisans would understand, the two frame pieces could also be made of a single piece of material, further eliminating positioning structures.

As further shown in FIG. 7, the axle 20 comprises a substantially horizontally-extending member that extends between the wheels 22 of the frame. The axle 20 comprises an "elevate" feature providing structural support to the device, and provides for a kick-point or contact-point that is useful for tipping the device toward an angled position for transport. For example, a user may place a foot on the axle and exert an outward force, while simultaneously placing a hand on the handle member 8 and providing a generally opposite force in order to transition the device from a position of rest to a tilted or angled position suitable for lifting the front end of the device, placing the weight of the device on the two rear wheels, and rolling the device.

FIG. 7 further depicts a storage member 18. The storage member 18 is provided between the vertical members of the first frame member 4 and is operable to receive, house and store various items and accessories including, but not limited to, replacement nozzles, cleaning products, various hand tools, hoses, etc.

FIG. 8-9 are top and bottom plan views of the device according to the FIG. 1 device, respectively. Various components and features of a pressure washer are provided in FIGS. 8-9. These features have already been shown and described herein with respect to FIGS. 1-7. FIGS. 8-9 are provided to further illustrate the relative position of various device components.

FIGS. 1-9 depict a pressure washing device having a frame member, and wherein the pressure washing device generally comprises a vertical orientation. It will be recognized, however, that the present disclosure is not limited to vertically-oriented pressure washing devices.

FIGS. 10A-11D provide various views of a frame member for a pressure washer according to another embodiment of the present disclosure. As shown, the device 50 comprises a frame member having an upper frame member 52 with a handle portion 54 and a lower frame member 58. The lower frame member 58 comprises at least one tubular member that partially surrounds the working components of a pressure washer including, for example, a pump 62 and a power source 64. The lower frame member 58 comprises arcuate members 61 that extend and connect to the upper frame member 52*a*, 52*b*. The lower portion 58 comprises an axle member 66 that serves as a support member between the wheels 68 and is further operable to be used as a kick-point to assist in tilting and moving the device 50.

As shown in FIGS. 10A-11D, the device 50 comprises a folding upper frame member having first 52*a* and second 52*b* portions. A hinge or pivot point 56 is provided at a union of the first and second portions 52*a*, 52*b* and wherein the first portion 52*a* is rotatable between at least a position of use (FIG. 10A, for example) and a position of storage (FIG. 10B, for example). As shown in FIG. 10C, the device 50 comprises a cradle member 65 for selectively receiving a washing wand 67 when the wand is not in use.

The embodiment of FIGS. 10A-11D comprises at least one and preferably two horizontally extending members 70. The horizontally extending members 70 extend between opposing portions of the lower frame member 58 and serve to stabilize and provide support to the device. Additionally, the members 70 comprise a mounting surface for at least one of the power source 64 and the pump 62. In the embodiment shown in FIGS. 10A-11D, the pump 62 is directly mounted to the power source 64 and the power source 64 is mounted to the members 70.

A plurality of feet 72 are provided on an underside of the lower frame member. The feet, which are contemplated as comprising rubber in at least some embodiments, provide a support surface for the device and serve to reduce vibration of the device in operation.

For illustrative purposes, a spray gun 60 is provided in FIGS. 10-11D. The spray gun 60 may rest or otherwise be provided on a portion of the frame when a wand and/or hose is connected (see FIGS. 10A, 10D, 11A, 11D). Additionally, a cradle or rest 71 (FIG. 10D) is provided on a portion of the device and wherein the spray gun 60 may be housed or stored on the rest 71 when the device is not in use or when the gun is not in use (see FIGS. 10B, 10C, 10E, 11B, 11C).

The device of FIGS. 10A-11D comprises a compact device that is void of a motor or engine mounting plate. As shown, the power source 64 is mounted directly to the tubular frame member. The device 50 comprises a compact design, particularly in the storage position, that enhances ease of use, transport, shipping, storage, etc.

Further, various features and embodiments of pressure washing devices are provided herein. It will be recognized, however, that various features are not necessarily specific to certain embodiments and may be provided on any one or more embodiments. The present disclosure and embodiments provided herein are not mutually exclusive and may be combined, substituted, and omitted. The scope of the invention(s) provided herein is thus not limited to any particular embodiment, drawing, or particular arrangement of features.

While various embodiments of the present disclosure have been described in detail, it is apparent that modifications and alterations of those embodiments will occur to those skilled in the art. However, it is to be expressly understood that such modifications and alterations are within the scope and spirit of the present disclosure. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A portable pressure washer comprising:

a first tubular member formed into an arcuate shape;

a second tubular member formed into an arcuate shape;

wherein the first tubular member comprises a pair of bends defining a handle portion and two support members extending away from the handle portion;

wherein the second tubular member comprises a plurality of bends to provide an arcuate support member;

wherein the first tubular member is secured to the second tubular member; and a driving member and a driven member, wherein the driving member comprises one of an engine and an electric motor, and the driven member comprises a pump;

wherein the driving member extends from the second tubular member in a first direction and the driven member extends from the second tubular member in a second direction; and wherein the driving member is secured to the driven member by fasteners and wherein the fasteners extend through the second tubular member and a compression force is provided by the driven member and the driving member to the second tubular member.

2. The pressure washer of claim 1, wherein the first tubular member is welded to the second tubular member.

3. The pressure washer of claim 1, wherein the second tubular member is welded to an axle member, wherein the axle member extends between a first wheel and a second wheel provided on the frame member.

4. The pressure washer of claim 1, wherein the first tubular member is secured to the second tubular member by at least one fastener.

5. The pressure washer of claim 3, wherein the second tubular member is secured to the axle member by at least one fastener.

6. The pressure washer of claim 1, wherein the driving member comprises an engine that extends upwardly from the arcuate support member and the pump extends downwardly from the arcuate support member.

* * * * *